US005588918A

United States Patent [19]

Eckman et al.

[11] Patent Number: 5,588,918

[45] Date of Patent: Dec. 31, 1996

[54] GOLF PUTTING CUP

[75] Inventors: Michael G. Eckman; Paul A. Smallwood, both of Chesterfield, Mo.

[73] Assignee: Taylor Nathan Co., Inc., St. Louis, Mo.

[21] Appl. No.: 563,343

[22] Filed: Nov. 28, 1995

[51] Int. Cl.[6] ..... A63B 69/36

[52] U.S. Cl. ..... 473/187

[58] Field of Search ..... 473/187, 188, 473/189

[56] References Cited

U.S. PATENT DOCUMENTS

| | | | |
|---|---|---|---|
| 154,784 | 9/1874 | Bogia | 273/178 X |
| D. 245,274 | 8/1977 | Jarrett | D21/234 |
| D. 264,115 | 4/1982 | Murphy | D21/234 |
| 1,287,903 | 12/1918 | Daily | 273/178 R |
| 1,295,437 | 2/1919 | Cogswell | 473/189 X |
| 1,513,917 | 11/1924 | Long | 273/178 A |
| 1,581,092 | 4/1926 | Brooks | 273/178 R |
| 1,669,861 | 5/1928 | Chisholm | 273/178 X |
| 1,682,601 | 8/1928 | Cunningham | 273/178 R |
| 1,683,875 | 9/1928 | Duffy et al. | 273/178 R |
| 2,031,525 | 2/1936 | Clarke | 273/178 R |
| 3,610,631 | 10/1971 | Mulherin | 273/178 R |
| 4,396,194 | 8/1983 | Seiferth | 273/178 A |

FOREIGN PATENT DOCUMENTS

| | | | |
|---|---|---|---|
| 3221 | 9/1905 | United Kingdom | 273/178 A |
| 22584 | 3/1915 | United Kingdom | 273/178 A |
| 195328 | 3/1923 | United Kingdom | 273/178 A |

*Primary Examiner*—George J. Marlo
*Attorney, Agent, or Firm*—Kalish & Gilster

[57] ABSTRACT

A golf putting practice device includes a base portion having a surface and a perimeter. The device includes substantially flat ramp structures, connected side-by-side around and substantially adjacent to the perimeter of the base portion. Each ramp structure has a first end and a second end and extends continuously therebetween. The first ends of the ramp structures are disposed radially outward from a center of the base portion so as to define a central cup area, with the portion of the at least one surface of the base portion between the first ends of the ramp structures forming the floor of such central cup area. The device also includes pivotal connection structures mounted to the surface, each of the ramp structures is loosely, pivotally connected at the first end thereof by one of the pivotal connection structures to the surface of the base portion. Each of the ramp structures, in normal putting practice position, extends outwardly from the pivotally connected first end thereof and downwardly until the second end of each of the ramp structures contacts a support surface for the device, to thereby facilitate rolling receipt of a golf ball into the central cup area of the base formed by the radially inwardly disposed first ends of the ramp structures. The putting practice device can be provided in combination with a container portion which connects to the base portion to disguise the putting practice cup device as some other commonly known item when the device is not being used for golf putting practice.

19 Claims, 6 Drawing Sheets

GOLF PUTTING CUP

BACKGROUND AND SUMMARY OF THE INVENTION

FIELD OF THE INVENTION

The present invention relates generally to the field of golf putting practice cups, and, more specifically, to a putting cup which may be presented as a novelty or advertising device, especially when combined with a container or another object which effectively camouflages the putting cup portion which forms the base of the combined device until the container and putting cup are separated for use of the putting practice cup alone.

SUMMARY OF THE INVENTION

Previously, various types of devices for use in practicing of a golfer's putting stroke have been developed. Although some of these cups can be used outdoors, in other cases they have been designed with the intention of permitting the user to practice indoors, for example, during inclement weather, or at odd, free moments during the course of a work day. At times, it is not desired that other people be aware that a golfer is spending certain periods of time practicing his or her putting stroke. However, none of the known putting practice cups are designed as a novelty item or to be disguised as some other common object until selectively placed in the normal putting practice use position.

A number of the known putting practice devices are formed of one piece, saucer-like constructions with perimeters that are round, rectangular, octagonal or basically star-shaped. These devices are relatively large in cross-section and, being somewhat rigid and non-collapsible, can be awkward and require a significant amount of space for storage and transport purposes.

Other known putting practice devices, while collapsible, and thus capable of being tucked away into a pocket or desk drawer, tend to be useful for only a very limited time because they are formed of paper or cardboard. Thus, repeated folding and normal use will cause rapid wear. Exposure to moisture speeds the degradation of these known putting cups and may even cause their collapse due to release of tapes or glues.

Still other known putting practice cups such those described in the patents which issued to Long (U.S. Pat. No. 1,513,917), Seiferth (U.S. Pat. No. 4,396,194) and Jarrett (U.S. Pat. No. Des. 245,274) have flexible "leaves" positioned around the perimeters thereof. However, these cups also cannot be collapsed for easy storage or transport and/or they cannot be readily disguised as some other object. In some cases the material of construction also lends itself to rapid breakdown with repeated use.

Two golf putting practice devices are disclosed in British patents G.B. 195,328 and G.B. 22,584, which issued to Goudie, et al. and Moser, respectively. Each of these cups includes leaves positioned around the perimeter and connected via pivot pins inserted transversely across the central area of each of the leaves, so that when a moving golf ball contacts an outside edge of one of the leaves and moves toward the center of the cup the proximal end of the leaf tilts downwardly and permits the ball to roll inwardly, off the leaf and into the cup. Because the outer end of the leaves are heavier than the inner ends, once the ball has entered the cup, the leaf automatically tilts back to its original position, much like a teeter-totter in effect. Like many of the known putting practice cups, and specifically because of their leaf construction, these devices cannot be made more compact for storage and are not designed to be disguised as some other object or used as a novelty item.

Accordingly, there is a need in the marketplace for a golf putting practice device which can be kept readily at hand for easy use in virtually any setting and which can also be provided in combination with another separate portion by which the cup is disguised. The additional, camouflaging portion is intended to have the overall appearance of some commonly seen object, such a beverage can, bottle, box, mug, stein, or other container, for example, and to be suitable for display of advertising indicia, slogans, or other graphic material, if desired. The additional, disguising portion of the combined device is also intended to be used to contain small objects or gift items, such as golf balls, a small towel, candy, etc..

It is intended that the new golf putting practice device be of simple construction so as to be readily used by anyone with little or no instruction, and that the materials of construction, although inexpensive, be durable so as to be suitable for repeated use over an extended period of time, with very little, if any, noticeable wear to the device. It is also among the goals of the present invention that the new device, having the features indicated, be capable of multiple uses, being both a useful sport practice apparatus which can be of a professional standard of quality, as well as being disguisable for broader use as a gift or novelty item.

Accordingly, in furtherance of the above goals, the present invention is, briefly, a golf putting practice device which includes a base portion having a surface and a perimeter. The device has substantially flat ramp structures, connected side-by-side around and substantially adjacent to the perimeter of the base portion. Each ramp structure has a first end and a second end and extends continuously therebetween. The first ends of the ramp structures are disposed radially outward from a center of the base portion so as to define a central cup area, with the portion of the at least one surface of the base portion between the first ends of the ramp structures forming the floor of such central cup area. The device also includes pivotal connection structures mounted to the surface, each of the ramp structures is loosely, pivotally connected at the first end thereof by one of the pivotal connection structures to the surface of the base portion. Each of the ramp structures, in normal putting practice position, extends outwardly from the pivotally connected first end thereof and downwardly until the second end of each of the ramp structures contacts a support surface for the device, to thereby facilitate rolling receipt of a golf ball into the central cup area of the base formed by the radially inwardly disposed first ends of the ramp structures.

The invention is also, briefly, the combination of the above golf putting practice cup device and a container portion which is selectively detachably connected to the putting practice cup device to disguise the putting practice cup device as some other commonly known item when the golf putting practice cup device is not being used for golf putting practice.

The container portion includes, briefly, a continuous side wall having a first edge and a second edge. The first edge and the second edge are each continuous and each define an area. The first edge extends away from the golf putting practice cup and the second edge is selectively detachably connected to the golf putting practice cup outwardly of the points at which the ramp structures are pivotally connected to the base portion of the golf putting practice device.

BRIEF DESCRIPTION OF THE DRAWINGS

Throughout the figures like parts will be indicated by like element numbers.

DESCRIPTION OF PRACTICAL EMBODIMENTS

With reference to the figures, 10 generally designates a golf putting cup practice and novelty device having a golf putting practice cup portion, generally designated 12, and a container portion, generally designated 14, which fits over and disguises the cup portion as another object when cup portion 12 is not being used for golf putting practice.

Figure 10:
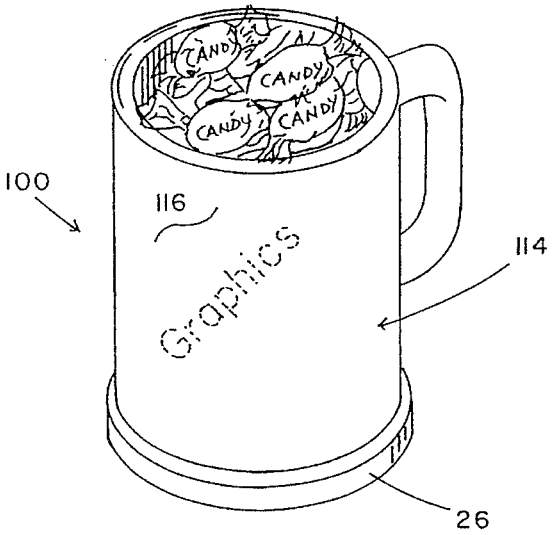
FIG. 10 is a perspective view of an alternative embodiment of the device of FIG. 1 with a coffee mug-type container portion.
Figure 11:
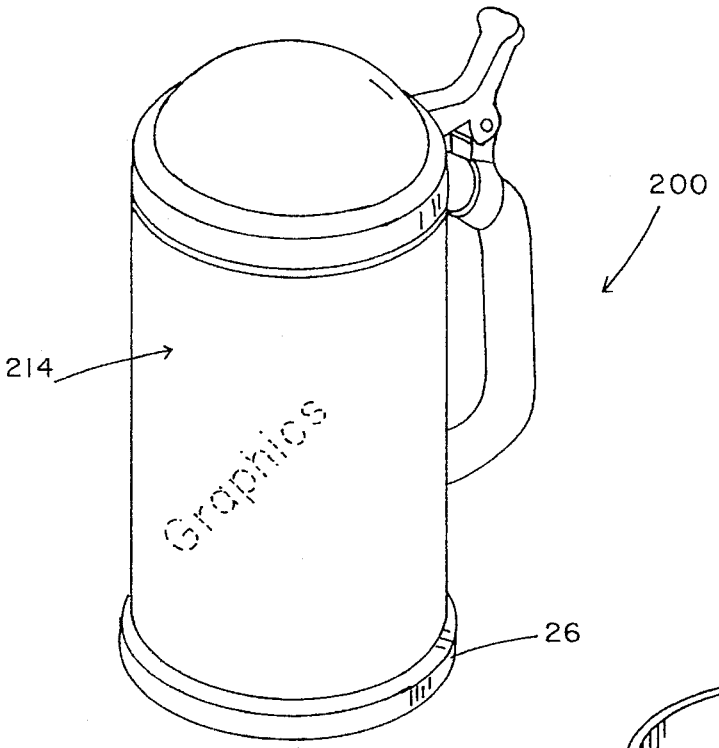
FIG. 11 is a perspective view of another alternative embodiment of the device of FIG. 1 with a beer stein-type container portion.
Figure 12:
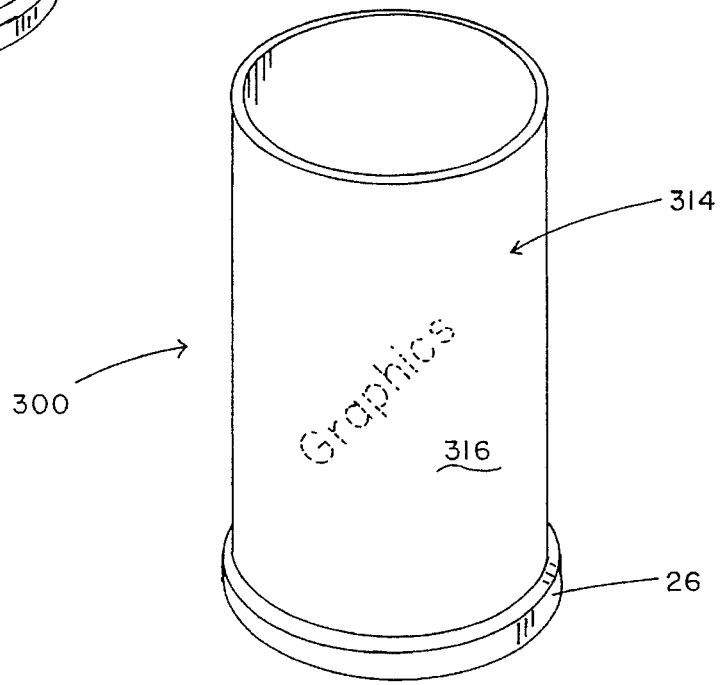
FIG. 12 is a perspective view of still another alternative embodiment of the device of FIG. 1 with a drinking glass-type container portion.

Alternative embodiments of the new device, each having a different type of container portion are illustrated in FIGS. 10, 11, and 12 and are generally designated as devices 100, 200, and 300, respectively. In each embodiment the putting cup portion 12 which forms the base of each device is substantially the same as that described hereafter with reference to the first embodiment. FIGS. 13–19 illustrate a variety of acceptable alterations on the structure of the putting cup portion of the new device which will be discussed in detail later herein. Accordingly, the same reference numbers will be used for elements that are the same in each embodiment.

Figure 1:
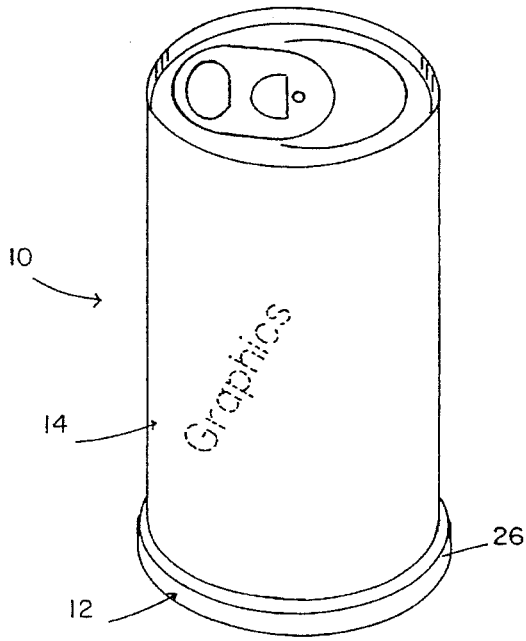
FIG. 1 is a perspective view of a combined golf putting cup/novelty item constructed in accordance with and embodying the present invention shown with the novelty container portion of the device mounted on the putting cup with such putting cup in non-use position.
Figure 2:
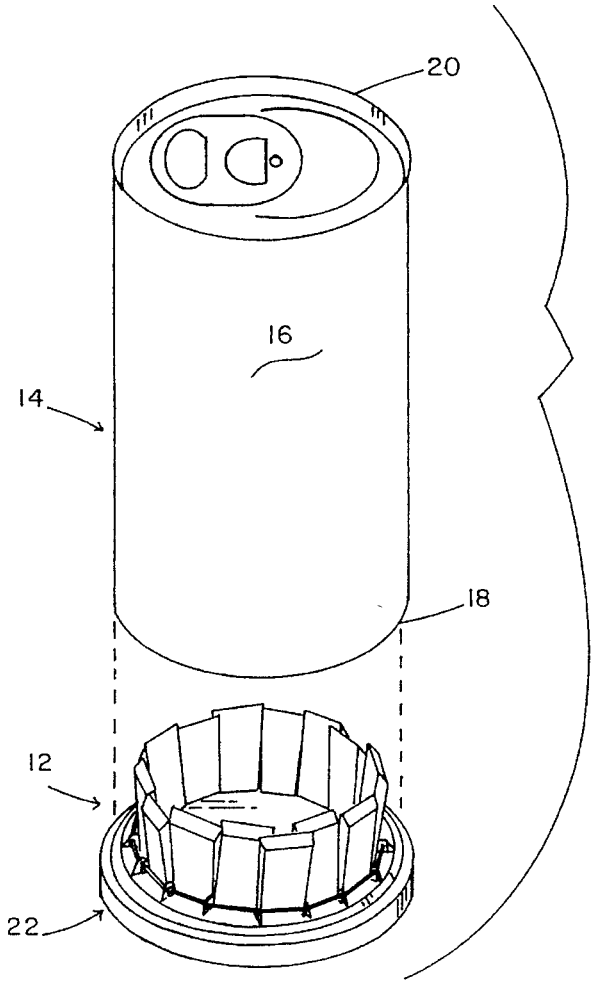
FIG. 2 is an exploded perspective view of the device of FIG. 1 shown with the novelty container portion lifted off the putting cup.

FIGS. 1 and 2 show container portion 14 formed with an appearance much like that of a conventional beverage can, such as those commonly used for soft drinks or beer. Container portion 14 preferably has a continuous, annular upstanding side wall 16 with a circular upper edge 18 and a circular lower edge 20, each edge defining an area. Although this embodiment of container portion 14 is preferably formed of metal, it may also be made of other materials, such as plastic, cardboard, etc., or various combinations thereof. Element 14 of device 10 is referred to for the most part as a "container" because it is well-suited for holding other articles such as golf balls, a small towel, candy, or other small, gift-type items (as illustrated in the alternative embodiment shown in FIG. 10, for example). Of course, element 14 may just as well be empty, if desired. Also, "container" portion 14 may certainly be sealed in a manner such that it cannot be opened, although an open bottomed version is preferred.

The outer surface of side wall 16 is ideally suited for and intended to be provided with printed or graphic material of any desired color, design or content. For example, under license from a trademark owner, the registered logo and mark of a beverage manufacturer may be used so that when in the closed, non-practice position, device 10 has the general appearance of an ordinary beverage container.

Furthermore, the overall shape of container portion 14 may also vary. For example the side wall may not necessarily be continuous, or it may have a different cross-sectional shape, such as rectangular or octagonal, for example. Effectively any cross-sectional shape of portion 14 may be suitable, as long as the lower edge 18 thereof and its shape are accommodated by corresponding adjustments in putting cup portion 12 so that the two portions may be selectively connected and disconnected repeatedly for putting practice use or disguised storage of cup portion 12, as desired, as further discussed hereafter.

The area defined by upper edge 18 may be closed in the usual manner, with a container top, as shown in FIG. 1, having, for example, a removable ring tab, or it may be completely sealed or otherwise openable in any known manner desired. The area defined by bottom edge 18 is preferably left entirely open, but, alternatively, may be closed by a container bottom wall (not shown) recessed up within the continuous side wall 16. In either case, the preferably continuous, annular bottom edge 18 per se is free from obstructions and is used to connect container portion 14 to cup portion 12 as described in further detail hereafter. It is of course conceivable that edge 18 could be discontinuous, and non-annular, if desired.

Figure 6:
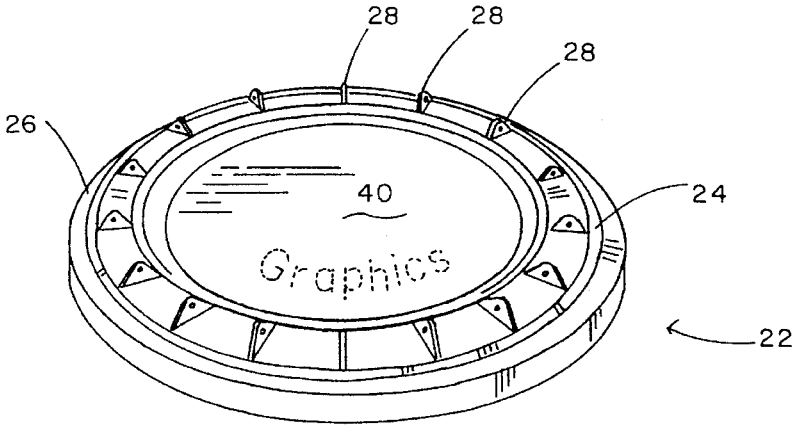
FIG. 6 is a perspective view of the central base portion shown in FIG. 4.
Figure 7:
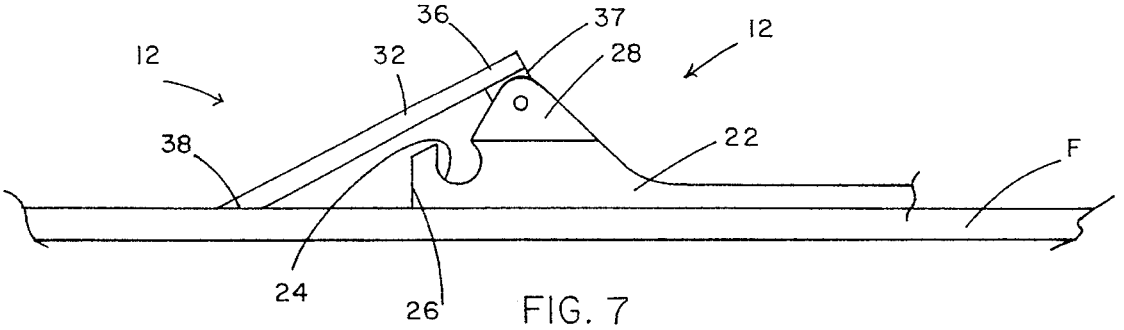
FIG. 7 is a partial schematic vertical section of the putting cup portion of the device of FIG. 1 taken on line 7—7 of FIG. 9.
Figure 8:
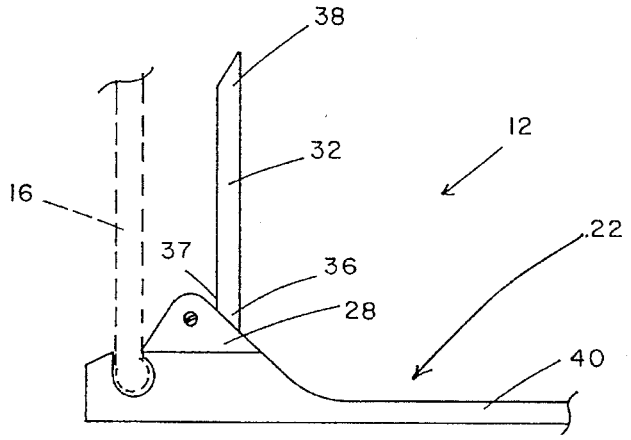
FIG. 8 is the same partial schematic vertical section as shown in FIG. 7, but with the petal pivoted upwardly to the storage position, the adjacent petals being omitted for clarity, and showing the side wall of the container, in phantom, in mounted position on the base.

With reference to FIG. 2 it will be seen that container portion 14 can be removed from putting cup portion 12 which, when connected to portion 14 serves as its base or bottom by connecting to bottom edge 18. FIGS. 2–8 show that putting cup portion 12 includes a central base portion 22 preferably having a recessed groove (or "channel") 24 contiguous with and adjacent to the perimeter or outer edge 26 which defines the extent of base portion 22. As shown in FIGS. 2 and 8, groove 24 is sized and positioned on base 22 appropriately for snugly receiving and retaining in snap-fit fashion the lower edge 18 of container portion 14 wall 16 to thereby permit the base to serve as a selectively removable bottom of the container.

Figure 3:
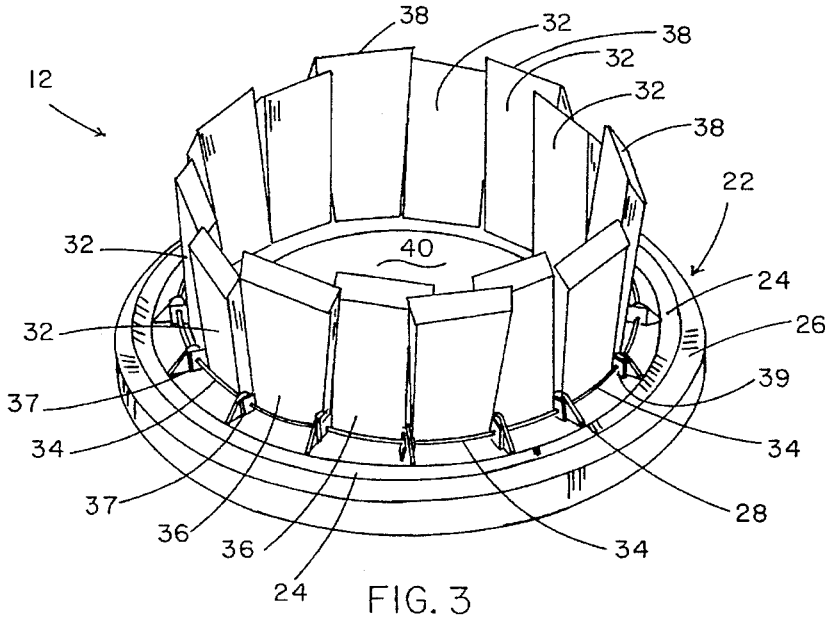
FIG. 3 is an enlarged perspective view of the putting cup with the pivotal petals thereof shown in a substantially vertical position for insertion into the container portion.
Figure 4:
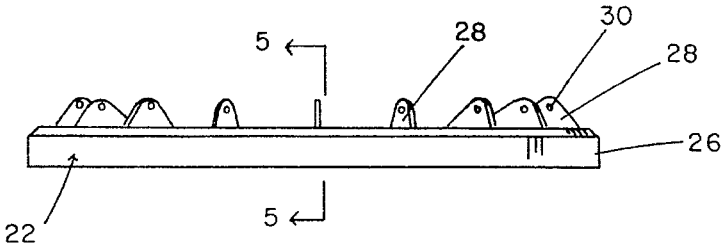
FIG. 4 is a side elevational view of the central base portion of the putting cup of FIG. 1 with the petals omitted to more clearly show the flanges to which the petals are normally mounted.
Figure 5:
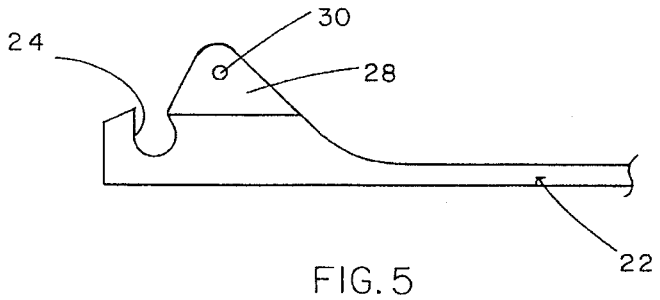
FIG. 5 is a partial schematic vertical section of the putting cup portion of the new device taken on line 5—5 of FIG. 4.

FIG. 3 shows putting cup portion 12 enlarged, for clarity and illustrates that inwardly of groove 24 on base 22 there are fixed a plurality of spaced-apart, radially disposed, upwardly extending flanges 28. Each flange 28 is provided with a transverse through-hole 30 for journaling a pivot shaft, such as wire 34, upon which an associated ramp structure, to be described, can pivot. A plurality of substantially flat, and preferably trapezoidal shaped "petals" or "leaves" 32 are disposed around and adjacent to the inside edge of groove 24. FIGS. 4, 5 and 6 show base portion 22, without leaves 32 connected to more clearly illustrate the position of flanges 28, substantially perpendicular to the plane of central base portion 22.

Each petal 32 has an inner end 36 and outer end 38. As shown in FIG. 2, when cup portion 12 is to be camouflaged as a beverage can outer ends 38 of petals 32 extend upwardly inside of annular wall 16. Inner ends 36 are each pivotally connected to central base 22, preferably by mounting via small brackets 37, as shown in FIGS. 3 and 7. Brackets 37 are substantially rectangular (and preferably, although not necessarily, relatively thin) and are fixed to each side of petal inner ends 36, substantially perpendicular to the plane of the petal, and have formed through-holes 39 (obstructed from view) which receive a continuous wire 34. Wire 34 is of sufficient length to extend entirely around cup portion 22, at a position spaced slightly inwardly of annular groove 24.

Alternatively, separate, individual pivot pins or shafts (not shown) can be provided to extend through the openings in each bracket 37 and connect the bracket to an adjacent upstanding flange 28 so that leaves 32 freely swing or hinge and are capable of moving easily to and from a substantially vertical storage position (shown in FIGS. 2, 3 and 8) with relation to base portion 22. Other alternative petal and base structures for the new putting cup are described later herein with reference to FIGS. 13–19.

Because of the preferred trapezoidal shape and connection with the narrower end of the petal trapezoid being the inner end, when leaves 32 are all in a substantially vertical storage position there is necessarily some overlap of the outer ends 38 when the inner ends 34 are positioned closely adjacent to one another, as in FIG. 3. The overlap does not interfere with the placement of the petals 32 into container portion 14 because the pivotal connections of the petals are sufficiently loose that the can be readily arranged as necessary to fit within the container. Moreover, the placement of groove (or channel) 24 can be at a greater distance outward of the pivotal connections of the petal inner ends 36 if necessary for optimal fit of container portion 14.

Figure 9:
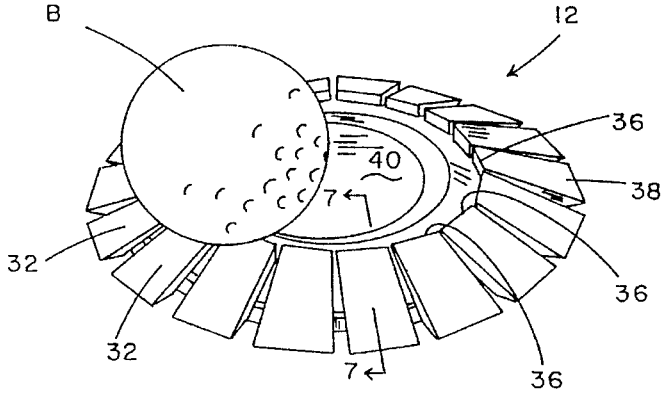
FIG. 9 is a perspective view of the putting cup portion of the device of FIG. 1 in use position with the novelty, container portion removed.

FIG. 9 shows leaves 32 extending over outer edge 26 central base 22 to angle downwardly and outwardly, thereby forming a plurality of angled ramp structures, radially disposed and extending away from base 22, toward a floor F or other support surface. Because of the preferred trapezoidal shape of petals 32 and the connection with the wider ends being positioned outwardly, the side edges of adjacent petals 32 are close enough together that there is no interference with golf ball B caused by the small space which remains between the adjacent ramps. Preferably, although not necessarily, outer ramp ends 38 are finished at an angle so as to rest flush against floor F, as shown in FIG. 7, for optimally smooth putting.

Although the described form and connection of petals 32 are preferred, certainly other constructions are conceivable which will function adequately. For example, the petal shape may be more rectangular and the inner ends thereof spaced slightly farther apart, and the edges of the petals, which are shown with relative sharp corners could be more rounded. These variations are offered only as examples and are not intended to be all inclusive.

FIG. 9 illustrates that the above-described structure for cup portion 12 permits an accurately approaching golf ball B to roll up and drop into the central cup area 40, centrally of the inner ends 36 of the leaves. As shown in FIG. 6, central cup area 40 is preferably substantially flat surfaced, but may also have a texture, or may have various height levels, and in any case may also, if desired, be used as a site for further advertising information or other graphics.

FIG. 8 illustrates the general position of a leaf 32 with relation to annular side wall 16 (phantom) when container portion 14 is disposed in its optional camouflaging position on base portion 22. It is to be understood that leaves 32 are preferred to pivot rather loosely on wire 34 or other equivalent attachment mechanisms. So constructed, when putting practice is complete, cup portion 12 can be picked up and suspended upside down by holding base portion 22. Leaves 32 will then dangle freely and substantially vertically below central base portion 22. In this position container portion 14 can be readily slidably arranged with wall 16 outside of suspended leaves 32.

Lower edge 18, which preferably includes a small bead or "lip", can then be easily snapped into groove 24 for detenting engagement therewith, to effectively and securely hide putter cup portion 12 inside of container portion 14 by disguising cup 12 as a beverage can until further putting practice is desired. In other words, once positioned on container portion 14, all that can be seen of putter cup portion 12 is edge 26, and if viewed from the bottom, the bottom surface (not seen) of base portion 22, which will give the general appearance of being the bottom of the can or other container portion substituted therefor (as illustrated by the examples of other embodiments described hereafter).

FIG. 10 illustrates an alternative embodiment 100 of the new putting practice device in which only the container portion 114 has changed, relative to the first embodiment, device 10, shown in FIGS. 1–9. In device 100 the container portion 114 takes the form of a coffee mug which, as shown, is open topped. If preferred, container portion 114 can be filled with any appropriate substance, as described above with reference to the first embodiment, and covered temporarily, for example by shrink-wrapping, or by other known closures.

The outer surface of side wall 116 of portion 114 can be used for advertising purposes or bear other decorative graphics, or can remain plain, as desired, just as in the case of the first embodiment. The bottom of container portion 114 can be omitted entirely, or, as with the first embodiment, a "false" or raised bottom (not shown) can be provided at a level high enough to permit insertion of the raised leaves 32 of the putting cup portion 12, which portion 12 can be of identical construction as that portion as described for the first embodiment.

FIG. 11 depicts another embodiment of the new putting practice device 200 which is the same as the first two embodiments described, except that the container portion 214 is formed as a beer stein with an optional lid. Otherwise the structure and use of device 200 is the same as described above.

FIG. 12 shows still another embodiment 300 of the new putting practice device, which is substantially identical in construction as the previous embodiments, with regard to the putting cup portion 12, but the novelty/container portion 314 is formed as a drinking glass. As with the embodiment indicated generally at 100 in FIG. 10, device 300 can optionally be provided either empty, or filled with any suitable substance for sale or gift-giving, and be left open-topped, as shown, or temporarily sealed, as may be desired. As with the previous embodiments, the outer side wall 316 of the container portion may be left plain, or decorated with advertising, pictures, text or graphics of virtually any kind known or imaginable.

Figure 13:
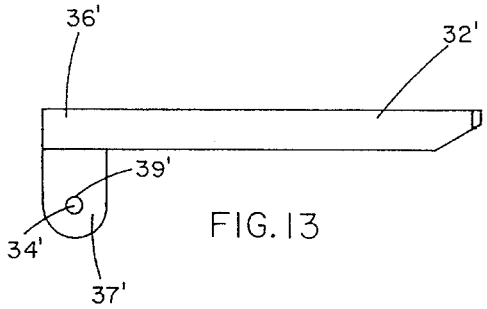
FIG. 13 is a side elevational schematic view of an alternative petal structure for the golf putting cup of FIG. 1.
Figure 14:
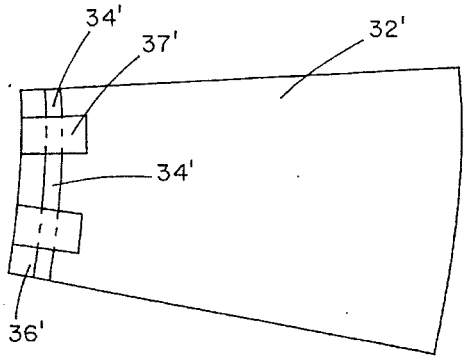
FIG. 14 is a bottom plan schematic view of the petal of FIG. 13.

One alternative structure for the base portion and petals of the new golf putting cup is illustrated in FIGS. 13–16. FIGS. 13 and 14 show an alternative petal 32', having the same general shape as the above-described petal 32, and being capable of being formed of the same materials. Petal 32' differs from that described in the first embodiment by having mounted on the lower surface of its inner end 36' at least one and preferably two (paired) mounting blocks or brackets 37' which are set inwardly of the two opposed side edges of petal 32'. Blocks 37' preferably have aligned through-holes 39' which serve to journal a shaft or pivot pin 34', or, as a further option, receive and permit passage therethrough of a wire such as that discussed above and indicated at 34 in FIG. 3, for connection of petals 32' to base 22'.

Figure 15:
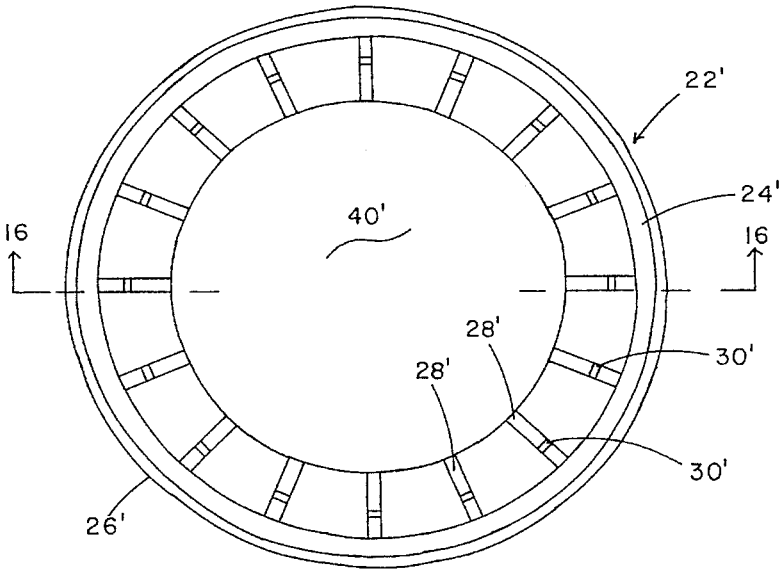
FIG. 15 is a top plan schematic view of an alternative central base structure for the putting cup of FIG. 1.
Figure 16:
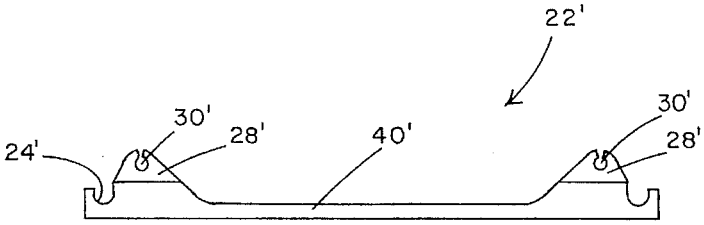
FIG. 16 is a vertical sectional view taken on line 16—16 of FIG. 15.

FIGS. 15 and 16 illustrate an alternative central base 22' for the new putting cup. Base 22' is specifically intended to be used with petals such as those described above and shown in FIGS. 13 and 14. In most respects, base 22' is identical to base 22, having and central putting area 40' and an annular outer edge 26', inwardly of which there is a formed channel 24'.

Radially inwardly of channel 24' there are fixed spaced apart, upwardly extending flanges 28', which surround putting area 40', as in the previous embodiment. Flanges 28', however, differ from the previous embodiment by being somewhat wider, or thicker, for reasons that will become clear, and by having at their upper extents formed grooves, or detents 30'. Grooves 30' replace through-holes 30 of the first embodiment and provide a position for snap-fit interconnection of the extreme ends of pivot shafts 34' or, in the described alternative, a continuous wire (such as in the embodiment of FIG. 3) which connects all petals 32' and is thick enough to be retained in grooves 30' without accidental release of leaves 30' from central base portion 22'.

In the case of pivot shafts or bars 34', as shown in FIG. 14, it is necessary that upstanding flanges 28' on base 22' each be wide enough in their transverse direction to be capable of receiving and pivotally seating the adjacent outer ends of two shafts 34' from adjacent petals 32'. Otherwise, a gap would necessarily be present between each petal 30' and the next, which gap would be so large as to interfere with the optimal rolling movement of a golf ball into the central putting are 40' of this alternative putting cup.

Figure 17:
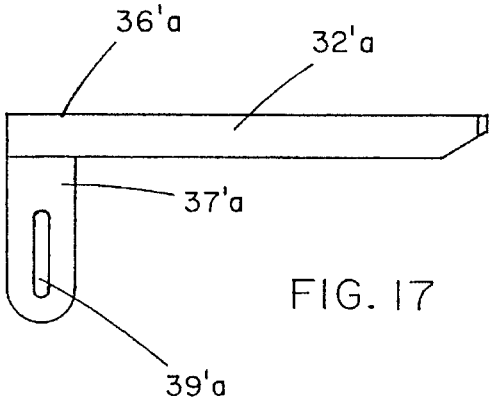
FIG. 17 is a side elevational schematic view of another alternative embodiment of the petal structure for the golf putting cup of FIG. 1.

FIG. 17 illustrates schematically another alternative structure, specifically, petal **32'*a*. This leaf or petal embodiment is intended for use with the central base portion 22 previously described with reference to FIG. 3. Petal 32'*a* is similar in general shape and construction to petal 32, having an inner end 36'*a* and a pair of depending flanges 37'*a*, of which pair, one flange 37'*a* is shown in side view. Flanges 37'*a* may be fixed to petal inner ends 36'*a* at the two opposing side edges thereof, as in the first embodiment, or, may be set in from the edges slightly, attached to the corresponding petal's lower surface, as shown in the second embodiment 32', previously described with reference to FIGS. 13 and 14. In either case, each flange 37'*a* is provided with an optimally rounded lower end and has an elongated aperture formed through the flange, longitudinally therewith, for receipt of mounting wire 34 (described above) or other equivalent devices for pivotal connection to central base portion 22**.

As with the other embodiments, flange **37'*a* may consist of a pair of such flanges, or may be a single flange or block ideally positioned centrally beneath end 36'*b***, or it may even be three or more spaced-apart thinner flanges.

Figure 18:
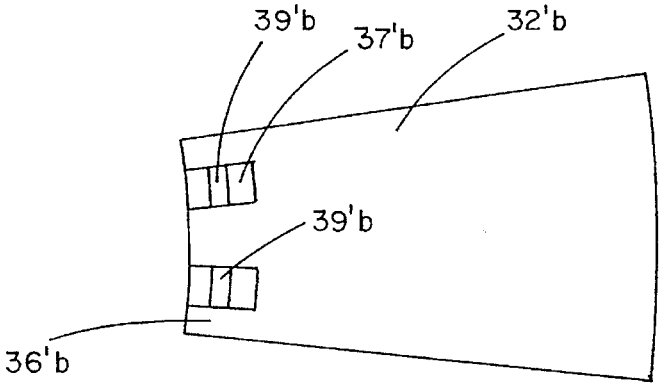
FIG. 18 is a bottom plan schematic view of still another alternative embodiment of the petal structure for the putting cup of FIG. 1.
Figure 19:
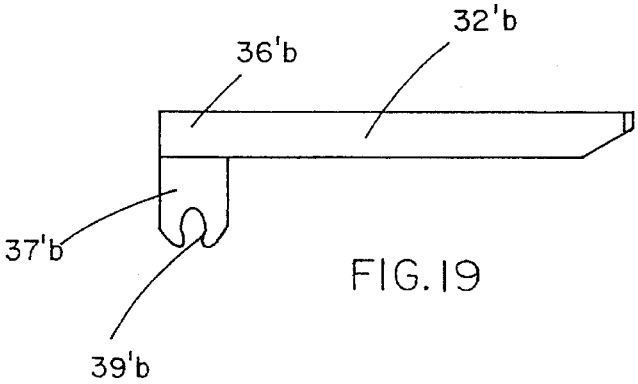
FIG. 19 is a side elevational schematic view of the petal of FIG. 18.

FIGS. 18 and 19 illustrate a still further alternative structural embodiment of a petal **32'*b* for use with the first-described central base portion 22 of the golf putting practice cup 12 (with reference to FIGS. 2–9). Leaves 32'*b* are also pivotally connected to base 22 and have the overall construction of the first embodiment. However, at their inner ends 36'*b* each petal 32'*b* has connected at least one, and preferably paired, depending blocks or flanges 37'*b* which, as described for earlier embodiments, may connected to the lower surface of the flange, inwardly from the sides, or be connected at the outer side edges, adjacent the inner end 37'*b* of each petal 32'*b*. The flanges 37'*b* of this petal embodiment vary from those previously described in the aperture 39'*b* is formed not as a through-hole or elongated slot, as above, but rather as an open-ended detent which can be used to snap-fit over wire (or pivot shafts) 34 of base 22. This snap-fit or detenting engagement of C-shaped apertures 39'*b* with wire 34 (or its equivalent) is loose enough to permit free pivotal movement of each petal 32'*b*, yet secure enough to prevent leaves 32'*b* from inadvertently separating a falling away from central base portion 22**.

In each of the embodiments described, as well as others which will readily be apparent upon review of the above description, the container portions and the putting cup portions are all amenable to being formed of a variety of materials. For example, in the embodiments shown in FIGS. 10, 11 and 12, the container portions can be formed of glass or ceramic. However, for safety, as well as for convenience and economy of manufacture, these portions may just as well be formed, at least in part, of plastic or inexpensive metal alloys, for example. Conceivably, even substances such as stiff paper or cardboard products may be formed appropriately and decorated for use as the container portions "disguising" the associated golf putting practice cup portions. Even other naturally occurring substances and synthetic materials yet to be produced may be suitable for forming the elements of the new device.

Also, as should be apparent from the above description and the figures, the new golf putting cup, including the cup portion and the container portion, can conceivably be formed with some cross-sectional shape other than the annular shape shown, with adequate results. The annular design is considered to be the most preferred, for aesthetic purposes, as well as for convenience of manufacture. Other shapes, however, such as an octagonal outline, are considered to be within the scope of the invention, as long as the putting cup portion and the container/novelty portions are suitably adapted for connection to each other in the general manner described above, to disguise the putting cup as another (usually commonly known) article until it is desired to use the cup portion for golf putting practice purposes.

In view of the foregoing, it will be seen that the several objects of the invention are achieved and other advantages are attained.

Although the foregoing includes a description of the best mode contemplated for carrying out the invention, various modifications are conceivable.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A golf putting practice device comprising:

a base portion having at least one surface and a perimeter, a plurality of substantially flat ramp structures, connected side-by-side around and substantially adjacent to the perimeter of the base portion, each ramp structure having a first end and a second end and extending continuously between the first end and the second end, the first ends of the ramp structures being disposed radially outward from a center of the base portion so as to define a central cup area, with the portion of the at least one surface of the base portion between the first ends of the plurality of ramp structures forming the floor of such central cup area, and a plurality of pivotal connection structures mounted to the at least one surface, each of the ramp structures being loosely, pivotally connected at the first end thereof by a corresponding one of the plurality of pivotal connection structures to the at least one surface of the base portion, each one of the plurality of ramp structures, in normal putting practice position, extending outwardly from the pivotally connected first end thereof and downwardly until the second end of each of the ramp structures contacts a support surface for the device, to thereby facilitate rolling receipt of a golf ball into the central cup area of the base formed by the radially inwardly disposed first ends of the ramp structures.

2. The golf putting practice device of claim 1, and further comprising a groove formed in the at least one surface inwardly of the perimeter and radially outward of the pivotal connection structures.

3. The device of claim 2, wherein the pivotal connection structures include a plurality of flanges connected to the least one surface, spaced apart from one another and disposed radially inward of the perimeter of said base portion.

4. The device of claim 3, wherein said pivotal connection structures include at least one pivot shaft and each one of said plurality of flanges connected to the at least one surface of said base portion has at least one through-hole for receiving a pivot shaft.

5. The device of claim 3, wherein the pivotal connection structures further include brackets fixed on the first end of each of said plurality of ramp structures, the brackets being adapted to receive pivot shafts, to thereby permit said plurality of ramp structures to be pivotally connected to said plurality of flanges connected to the at least one surface of said base portion.

6. The device of claim 4, wherein the at least one pivot shaft comprises an elongated flexible member which is received in the through-hole of each of the flanges fixed to the base portion.

7. The device of claim 4, wherein the at least one pivot shaft comprises a plurality of pivot pins which pivotally connect the first ends of the ramp structures to adjacent spaced-apart flanges fixed on the at least one surface of the base portion.

8. The device of claim 1, wherein the perimeter of said base defines an annular area.

9. The device of claim 8, wherein the at least one surface is substantially flat, and a portion of the at least one surface is radially inward of the first ends of the plurality of ramp surfaces and forms a central cup area of said golf putting practice device.

10. The device of claim 1, wherein the device is formed at least partly of metal.

11. The device of claim 1, wherein the device is formed at least partly of plastic.

12. The combination of a golf putting practice cup device and container portion which is selectively detachably connected to the putting practice cup device to disguise the putting practice cup device as some other commonly known item when the putting practice cup device is not being used for golf putting practice, said putting practice cup comprising a base portion having at least one surface and a perimeter, a plurality of substantially flat ramp structures, connected side-by-side around and substantially adjacent to the perimeter of the base portion, each ramp structure having a first end and a second end and extending continuously between the first end and the second end, the first ends of the ramp structures being disposed radially outward from a center of the base portion so as to define a central cup area, with the portion of the at least one surface of the base portion between the first ends of the plurality of ramp structures forming the floor of such central cup area, and a plurality of pivotal connection structures mounted to the at least one surface, each of the ramp structures being loosely, pivotally connected at the first end thereof by a corresponding one of the plurality of pivotal connection structures to the at least one surface of the base portion, each one of the plurality of ramp structures, in normal putting practice position, extending outwardly from the pivotally connected first end thereof and downwardly until the second end of each of the ramp structures contacts a support surface for the device, to thereby facilitate rolling receipt of a golf ball into the central cup area of the base formed by the radially inwardly disposed first ends of the ramp structures.

13. The combination of claim 12, wherein the container portion comprises a continuous side wall having a first edge and a second edge, the first edge and the second edge each being continuous and defining an area, the first edge extending away from the golf putting practice cup and the second edge being selectively detachably connected to the golf putting practice cup outwardly of the points at which the ramp structures are pivotally connected to the base portion of the golf putting practice device.

14. The combination of claim 13, wherein the second edge of the container portion has a lip and the base has groove formed entirely around and adjacent to the perimeter, radially outwardly of the positions on the base where the first ends of the plurality of ramp structures are pivotally connected to the base, the groove being sized, shaped and position on the base for detenting receipt of the lip on the second edge of the container portion, to thereby permit insertion of the plurality of ramp structures inside of the container portion and connection of the putting practice device to the container portion in such manner that the putting practice device appears to be the bottom of the container portion and is thus disguised by the container portion.

15. The combination of claim 14, wherein the container portion also includes a top which closes the area defined by the first edge.

16. The combination of claim 14 wherein the container portion first edge defines an area which is open.

17. The combination of claim 12, wherein the container portion has the appearance of a beverage can.

18. The combination of claim 12, wherein the container portion has the appearance of a coffee mug.

19. The combination of claim 12, wherein the container portion has the appearance of a drinking glass.

* * * * *